US011338323B2

(12) United States Patent
Yoon et al.

(10) Patent No.: US 11,338,323 B2
(45) Date of Patent: May 24, 2022

(54) METHOD OF IMPROVING ADHESIVE STRENGTH BETWEEN HETEROGENEOUS MATERIALS OF METAL AND RESIN

(71) Applicants: Hyundai Motor Company, Seoul (KR); Kia Motors Corporation, Seoul (KR); Chung-Ang University Industry-Academy Cooperation Foundation, Seoul (KR)

(72) Inventors: Sung Ho Yoon, Gyeonggi-do (KR); Yun Ho Cho, Seoul (KR); Gyu Hyeong Choe, Gyeonggi-do (KR); Jong Hwi Lee, Seoul (KR); Soo Min Bae, Seoul (KR)

(73) Assignees: Hyundai Motor Company, Seoul (KR); Kia Motors Corporation, Seoul (KR); Chung-Ang University Industry-Academy Cooperation Foundation, Seoul (KR)

( * ) Notice: Subject to any disclaimer, the term of this patent is extended or adjusted under 35 U.S.C. 154(b) by 86 days.

(21) Appl. No.: 16/694,421

(22) Filed: Nov. 25, 2019

(65) Prior Publication Data

US 2020/0353506 A1 Nov. 12, 2020

(30) Foreign Application Priority Data

May 7, 2019 (KR) ..... 10-2019-0053188

(51) Int. Cl.

| | |
|---|---|
| ***B05D 7/14*** | (2006.01) |
| ***B05D 3/10*** | (2006.01) |
| ***B05D 3/02*** | (2006.01) |
| ***B05D 1/18*** | (2006.01) |
| ***B05D 1/02*** | (2006.01) |

(52) U.S. Cl.

CPC ..... *B05D 7/14* (2013.01); *B05D 3/0254* (2013.01); *B05D 3/102* (2013.01); *B05D 1/02* (2013.01); *B05D 1/18* (2013.01); *B05D 2202/30* (2013.01); *B05D 2502/00* (2013.01); *B05D 2503/00* (2013.01); *B05D 2518/12* (2013.01)

(58) Field of Classification Search

CPC . B05D 1/02; B05D 1/18; B05D 3/002; B05D 3/102; B05D 3/0254; B05D 7/14; B05D 7/16; B05D 7/26; B05D 2202/25; B05D 2202/30; B05D 2350/60; B05D 2503/00; B05D 2502/00; B05D 2502/005; B05D 2518/10

See application file for complete search history.

(56) References Cited

U.S. PATENT DOCUMENTS

2004/0118482 A1 * 6/2004 Steinmetz ..... C23C 22/48 148/252

FOREIGN PATENT DOCUMENTS

| | | | | |
|---|---|---|---|---|
| CA | 2042659 A1 * | 11/1991 | ..... | C08G 59/621 |
| CA | 2182395 A1 * | 8/1995 | ..... | C23C 22/53 |
| GB | 2222592 A * | 3/1990 | ..... | B32B 7/12 |
| WO | 2014-118244 A1 | 8/2014 | | |

* cited by examiner

*Primary Examiner* — William P Fletcher, III

(74) *Attorney, Agent, or Firm* — Mintz Levin Cohn Ferris Glovsky and Popeo, P.C.; Peter F. Corless

(57) ABSTRACT

A method of attaching heterogeneous materials comprising pretreating the surface of a metal plate with an aromatic compound containing a pyrogallol group to bind the pyrogallol group to the surface of the metal plate and coating the pyrogallol-group-bound metal plate with a polymer resin, thereby greatly improving the adhesive strength between the metal plate and the polymer resin.

10 Claims, 3 Drawing Sheets

METHOD OF IMPROVING ADHESIVE STRENGTH BETWEEN HETEROGENEOUS MATERIALS OF METAL AND RESIN

CROSS-REFERENCE TO RELATED APPLICATION

This application claims, under 35 U.S.C. § 119(a), the benefit of priority to Korean Patent Application No. 10-2019-0053188, filed on May 7, 2019, the entire contents of which are incorporated herein by reference.

TECHNICAL FIELD

The present invention relates to a method of greatly improving adhesive strength between heterogeneous materials, for example, a metal plate and a polymer resin, at room temperature through a simple process.

BACKGROUND

Coating a metal material with a polymer is mainly applied to the coating of a chromium-plated surface. A representative example of this is a radiator grille, which may include a vehicle part. In general, in order to add a design element to a chromium-plated radiator grille, only a part thereof is coated with a color such as black or metal to produce a product. For example, in order to obtain a radiator grille, first, a plastic is injection-molded and then chromium plating is performed on this injection-molded product by a wet plating method. The surface of the chromium-plated radiator grille is coated using a color spray and is then dried to complete a product having a unique color. However, when the chromium-plated surface is coated with a color spray, adhesion between the metal and the polymer is poor, causing coating peeling and thus deterioration of the product.

In order to solve the phenomenon of coating peeling, it is important to improve the adhesive strength between the metal and the polymer. Typically, it is general to surface-treat metals using chemicals via chemical reactions or hydrogen bonds. This method can improve the adhesive strength between the metal and the polymer due to oxidizing groups on the metal surface. Accordingly, as the number of oxidizing groups present on the metal surface increases, the method becomes more advantageous. The oxidizing group on the metal surface refers to a functional group such as —OH, COOH, —O— or M-OH (wherein M is a metal element).

However, as the number of oxidizing groups on the surface of the metal increases, properties such as water resistance and heat resistance may be deteriorated and adhesive strength may be rapidly lowered upon exposure to various environments for a long period of time. In the related art, a polymeric adhesive agent containing a catechol group such as polyphenols has been used. The polymeric adhesive agent may be an advantage in that it can directly bind to the polymer even though an oxidizing group is not present on the metal surface. However, the catechol group has a problem in that the adhesive force is lowered upon exposure to various environments since it is derived from a water-soluble substance such as dopamine.

The above information disclosed in this Background section is provided only for enhancement of understanding of the background of the invention and therefore it may contain information that does not form the prior art that is already known in this country to a person of ordinary skill in the art.

SUMMARY

The present invention has been made in an effort to solve the above-described problems associated with the prior art.

It is an object of the present invention to provide a method of greatly improving adhesive strength between heterogeneous materials of a metal and a resin by pretreating the surface of a metal plate with an aromatic compound containing pyrogallol.

The objects of the present invention are not limited to those described above. The objects of the present invention will be clearly understood from the following description and can be implemented by the means defined in the claims and combinations thereof.

In an aspect, the present invention provides a method of improving an adhesive strength between heterogeneous materials of a metal and a resin. In an aspect, further provided is a method of attaching heterogeneous materials, for example, a metal component and a polymer resin. The heterogeneous material may include a metal plate and a polymer resin.

The term "adhering" or "attaching" as used herein may be used interchangeably without limitation. Such terms, "adhering" or "attaching", refers to an action to bring at least two or more components or materials close enough such that the two or more components may be physically connected or contact to each other via at least one or more portions of surfaces thereof.

The term "improving" or "improvement" as used herein refers to increase, or increasing a property of an article or product, for example by treating or processing, by about 10%, by about 20%, by about 30%, by about 40%, by about 50%, by about 60%, by about 70%, by about 80%, by about 90%, by about 100%, by about 100%, by about 200%, by about 300%, by about 400%, by about 500%, or greater, compared to the un-treated or un-processed article or product.

In one preferred aspect, the method may include removing impurities from a surface of a metal plate, after such removing the impurities, treating the metal plate with a pretreatment solution including an aromatic compound having a pyrogallol group and a solvent component, coating the surface of the pretreated metal plate with a polymer resin and drying the polymer resin coated on the metal plate.

The metal plate may suitably include metal components including, for example, one or more selected from the group consisting of trivalent chromium, hexavalent chromium, and aluminum, or an alloy thereof.

The pretreatment solution may suitably include an amount of about 0.1 to 15% by weight of the aromatic compound containing the pyrogallol group and an amount of about 85 to 99.9% by weight of the solvent based on the total weight of the pretreatment solution.

The aromatic compound may suitably include myricetin, gallacetophenone and a combination thereof.

The solvent component may suitably include one or more selected from the group consisting of methanol, ethanol, and propanol.

The pretreatment may be carried out by spray coating or immersion.

The immersion may be carried out by immersing the metal plate in a pretreatment solution and ultrasonicating the metal plate at a temperature of about 10 to 30° C. for about 1 to 10 minutes.

The pretreated metal plate may suitably include carbon atoms bound to the surface of the metal plate in an amount of about 30 to 50 atomic percent (at %) with respect to the entire surface area of the metal plate.

The polymer resin may suitably include one or more selected from the group consisting of polydimethylsiloxane (PDMS), polyurethane, and polyacryl.

The polydimethylsiloxane (PDMS) polymer may be a compound represented by the following Formula 1.

[Formula 1]

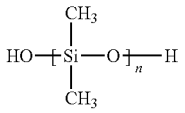

wherein n is an integer of 10 to 100.

The drying may be carried out by heat-treating at a temperature of about 65 to 100° C. for about 20 to 30 hours.

In one preferred aspect, provided is a vehicle part including a metal component and a polymer resin. Particularly, a surface of the metal component may be pretreated with a pretreatment solution comprising an aromatic compound having a pyrogallol group and a solvent component.

Preferably, the metal component may be a metal plate.

Preferably, the polymer resin may be coated on the pretreated metal component.

The metal component may suitably include one or more selected from the group consisting of trivalent chromium, hexavalent chromium, and aluminum, or an alloy thereof.

The pretreatment solution may suitably include an amount of about 0.1 to 15% by weight of the aromatic compound comprising the pyrogallol group and an amount of about 85 to 99.9% by weight of the solvent, based on the total weight of the pretreatment solution.

The aromatic compound may suitably include myricetin, gallacetophenone or a combination thereof.

The solvent component may suitably include one or more selected from the group consisting of methanol, ethanol, and propanol.

Also provided is a vehicle part including the heterogeneous materials that may be produced by the method described herein.

Further provided is a vehicle including the vehicle part as described herein.

Other aspects of the invention are disclosed infra.

BRIEF DESCRIPTION OF THE DRAWINGS

The above and other features of the present invention will now be described in detail with reference to certain exemplary embodiments thereof illustrated in the accompanying drawings which are given hereinbelow by way of illustration only, and thus are not limitative of the present invention, and wherein.

DETAILED DESCRIPTION

Figure 1:
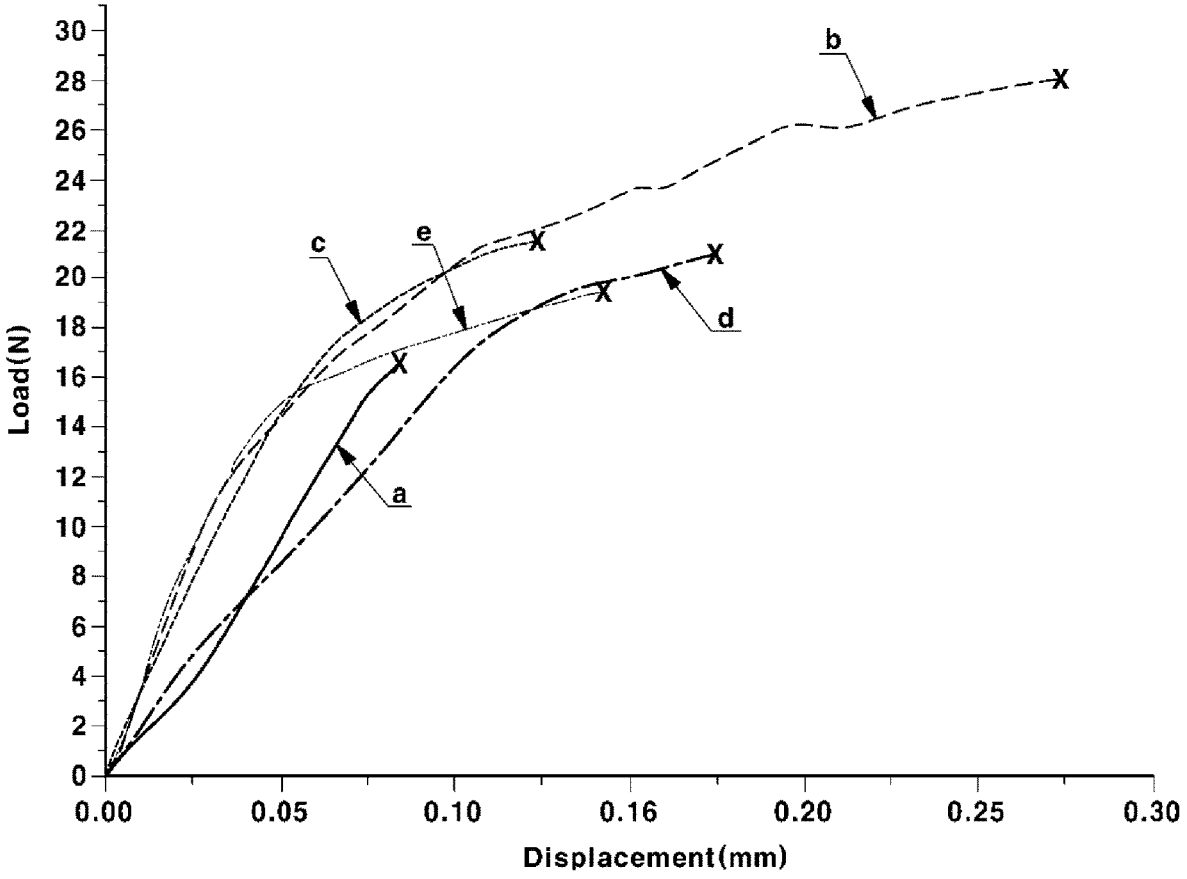
FIG. 1 shows a graph showing the results of DCB (double cantilever beam) evaluation regarding specimens produced in Example 1 according to an exemplary embodiment of the present invention and Comparative Examples 1 to 4.

The objects described above, and other objects, features and advantages of the present invention, will be clearly understood from the following preferred embodiments with reference to the attached drawings. However, the present invention is not limited to the embodiments, and may be embodied in different forms. The embodiments are suggested only to offer a thorough and complete understanding of the disclosed context and to sufficiently inform those skilled in the art of the technical concept of the present invention.

Like numbers refer to like elements throughout the description of the figures. In the drawings, the sizes of structures are exaggerated for clarity. It will be understood that, although the terms "first", "second", etc. may be used herein to describe various elements, these elements should not be construed to be limited by these terms, which are used only to distinguish one element from another. For example, within the scope defined by the present invention, a "first" element may be referred to as a "second" element, and similarly, the "second" element may be referred to as the "first" element. Singular forms are intended to include plural forms as well, unless the context clearly indicates otherwise.

It will be further understood that the terms "comprises" and/or "has", when used in this specification, specify the presence of stated features, integers, steps, operations, elements, components or combinations thereof, but do not preclude the presence or addition of one or more other features, integers, steps, operations, elements, components, or combinations thereof. In addition, it will be understood that when an element such as a layer, film, region or substrate is referred to as being "on" another element, it can be directly on the other element, or an intervening element may also be present. It will also be understood that when an element such as a layer, film, region or substrate is referred to as being "under" another element, it can be directly under the other element, or an intervening element may also be present.

Unless the context clearly indicates otherwise, all numbers, figures and/or expressions that represent ingredients, reaction conditions, polymer compositions and amounts of mixtures used in the specification are approximations that reflect various uncertainties of measurement occurring inherently in obtaining these figures, among other things. For this reason, it should be understood that, in all cases, the term "about" should be understood to modify all numbers, figures and/or expressions. In addition, when numerical ranges are disclosed in the description, these ranges are continuous and include all numbers from the minimum to the maximum including the maximum within each range unless otherwise defined. Furthermore, when the range refers to an integer, it includes all integers from the minimum to the maximum including the maximum within the range, unless otherwise defined.

It should be understood that, in the specification, when a range is referred to regarding a parameter, the parameter encompasses all figures including end points disclosed within the range. For example, the range of "5 to 10" includes figures of 5, 6, 7, 8, 9, and 10, as well as arbitrary sub-ranges such as ranges of 6 to 10, 7 to 10, 6 to 9, and 7 to 9, and any figures, such as 5.5, 6.5, 7.5, 5.5 to 8.5 and 6.5 to 9, between appropriate integers that fall within the range. In addition, for example, the range of "10% to 30%" encompasses all integers that include numbers such as 10%, 11%, 12% and 13% as well as 30%, and any sub-ranges of 10% to 15%, 12% to 18%, or 20% to 30%, as well as any numbers, such as 10.5%, 15.5% and 25.5%, between appropriate integers that fall within the range.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Hereinafter, the present invention will be described in detail with reference to various exemplary embodiments.

Provided is a method of attaching heterogeneous materials, for example, a metal and a polymer resin, at room temperature through a simple process.

Particularly, the method may improve the adhesive strength between heterogeneous materials of a metal (e.g., metal plate) and a polymer resin may include: removing impurities from the surface of the metal plate; treating the metal plate free of the impurities with a pretreatment solution including an aromatic compound having a pyrogallol group and a solvent; coating the surface of the pretreated metal plate with a polymer resin; and drying the polymer resin coated on the metal plate.

In the step of removing impurities from the surface of the metal plate, the metal plate may include metal components including one or more selected from the group consisting of trivalent chromium, hexavalent chromium, and aluminum, or an alloy thereof. In the step of removing the impurities, the metal plate may be immersed in water, subjected to primary ultrasonication for about 8 to 15 minutes, immersed in an alcohol solvent, and then subjected to secondary ultrasonication for about 8 to 15 minutes in order to remove the impurities from the surface of the metal plate. After the secondary ultrasonication, vacuum drying may be performed for about 10 to 15 hours to dry the metal plate.

In the step of pretreating the metal plate from which the impurities have been removed, the pretreatment solution may include an amount of about 0.1 to 15% by weight of the aromatic compound including a pyrogallol group and an amount of about 85 to 99.9% by weight of the solvent component, based on the total weight of the pretreatment solution.

The pyrogallol group may be a compound represented by the following Formula 2.

[Formula 2]

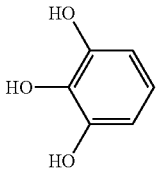

The pyrogallol group may have an advantage of having improved adhesive strength between a metal product (e.g., metal plate) and a polymer resin due to redox potential less than that of a conventional catechol group. In addition, the pyrogallol group may make a resin to directly bind to a metal even in the absence of an oxidizing group on the surface of the metal due to the excellent reducing power thereof. Moreover, the pyrogallol group may maintain the adhesive strength between the metal and the resin, even when exposed to various environments for a long period of time. Further, the pyrogallol group may have improved adhesive strength between the metal component (e.g., metal plate) and a polymer resin compared to a conventional reactive compound such as trimesoyl chloride or benzophenone.

The aromatic compound may be a compound containing a pyrogallol group, and for example, may include myricetin, gallacetophenone and a combination thereof. Preferably, the aromatic compound may be myricetin represented by the following Formula 3. The myricetin has advantages of having excellent reducing power and thus metal affinity.

[Formula 3]

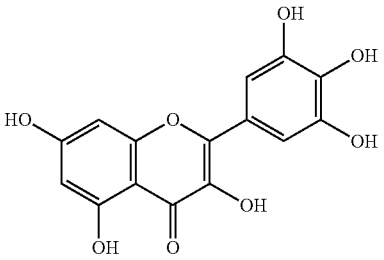

When the content of the aromatic compound is less than about 0.1% by weight, the pyrogallol group may not be properly bound to the surface of the metal plate, so that the effect of improving the adhesive strength between the metal plate and the polymer resin may not be sufficient. On the other hand, when the content of the aromatic compound is greater than about 15% by weight, dissolution may not be sufficient. Preferably, the pretreatment solution may contain an amount of about 1 to 10% by weight of the aromatic compound and an amount of about 90 to 99% by weight of the solvent component based on the total weight of the pretreatment solution.

The solvent may include one or more selected from the group consisting of methanol, ethanol, and propanol.

In the step of pretreatment, the pretreatment may be carried out by spray coating or immersion. The immersion method may be carried out by immersing the metal plate in a pretreatment solution and ultrasonicating the same at a temperature of about 10 to 30° C. for about 1 to 10 minutes.

The pretreatment solution residue after the pretreatment may be washed away using the solvent component.

In the pretreatment step, the adhesive strength between the metal plate and the polymer resin maybe improved by binding the pyrogallol group to the surface of the metal plate. The pretreated metal plate may include carbon atoms bound to the surface of the metal plate in an amount of about 30 to 50 atomic percent (at %) with respect to the entire surface area of the metal plate. The carbon atom may be derived from the pyrogallol group. When the amount of the carbon atoms that is bound is less than about 30 atomic percent (at %), the polymer resin may not sufficiently bind to the metal plate. When the amount of the carbon atoms that is bound is greater than about 50 atomic percent, the surface may be weakened due to the multi-layered surface structure. Preferably, an amount of about 30 to 40 atomic percent of carbon atoms may bind to the surface of the metal plate.

In the step of coating the polymer resin, the polymer resin may include one or more selected from the group consisting of polydimethylsiloxane (PDMS), polyurethane, polyacryl. The polydimethylsiloxane (PDMS) polymer may be a compound represented by the following Formula 1.

[Formula 1]

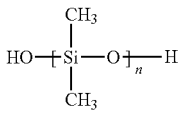

wherein n is an integer of 10 to 100.

In the step of coating the polymer resin, the polymer resin may be coated on the surface of the metal plate by a spray-coating method. Preferably, the polymer resin may be coated in an amount of about 1 to 10 g/m$^2$.

The drying may be carried out by heat-treating at a temperature of about 65 to 100° C. for about 20 to 30 hours. When the drying temperature is less than about 65° C., contamination may occur during the long drying time. On the other hand, when the drying temperature is greater than about 100° C., defects may occur in the dried layer. Preferably, the drying temperature may range from about 68 to about 75° C.

As described above, the method for improving the adhesive strength between a metal component (e.g., a metal plate) and a polymer resin may include pretreating the surface of a metal plate with an aromatic compound containing a pyrogallol group such the pyrogallol group may bind to the surface of the metal plate. The method may include coating the pyrogallol-group-bound metal plate with a polymer resin, thereby improving the adhesive strength between the metal and the polymer resin.

In addition, the method of improving the adhesive strength between a metal component (e.g., metal plate) and a polymer resin according to the exemplary embodiments of the present invention may be suitably performed by coating the surface of the metal plate with a pyrogallol group at room temperature in a simple spray-coating or dipping manner.

EXAMPLE

Hereinafter, the present invention will be described in more detail with reference to examples. However, the following examples should not be construed as limiting the scope of the present invention.

[Preparation of Materials]

Quercetin hydrate (95%), myricetin, trimesoyl chloride and benzophenone were purchased from Sigma Aldrich (St. Louis, Mo., USA) and used for pretreatment of a metal plate. Trivalent chromium plates (black), as metal plates, were purchased from Samshin Chemical (Gyeonggi, Republic of Korea). A mixture of Sylgard 184A and Sylgard 184B (mixing ratio of 10:1 w/w, Dow Corning, Midland, Mich., USA) was used as PDMS. Distilled water, sulfuric acid and ethanol were purchased from Daejung Chemicals (Gyeonggi, Republic of Korea).

Example 1

A 10 mm×50 mm chromium plate was prepared using a diamond saw (METSAW-LS Diamond Cutter, R & B, Daejeon, Korea). The chromium plate was ultrasonicated (NXP-1002, KODO, Korea) in water for 10 minutes and then ultrasonicated in ethanol for 10 minutes to remove contaminants from the surface of the specimen. The chromium plate free of the contaminants was vacuum-dried for 12 hours and then immersed in a pretreatment solution. At this time, the pretreatment solution that was used was a myricetin solution containing 2% by weight of myricetin and 98% by weight of methanol. Then, the immersed chromium plate was ultrasonicated for 5 minutes and then washed with methanol to prepare a pretreated chromium plate. PDMS was applied onto the surface of the pretreated chromium plate and dried at a temperature of about 70° C. for 24 hours to produce a specimen.

Comparative Example 1

A specimen was produced in the same manner as in Example 1 except that no pretreatment was carried out.

Comparative Example 2

A quercetin solution containing 2% by weight of quercetin hydrate (95%) and 98% by weight of methanol was used as a pretreatment solution. The chromium plate immersed in the pretreatment solution was ultrasonicated for 5 minutes and then washed with methanol to prepare a pretreated chromium plate. A specimen was produced in the same manner as in Example 1 except for the process described above.

Comparative Example 3

A trimesoyl chloride solution containing 2% by weight of trimesoyl chloride and 98% by weight of hexane was used as a pretreatment solution. The chromium plate immersed in the pretreatment solution was ultrasonicated for 5 minutes and washed with hexane to prepare a pretreated chromium plate. A specimen was produced in the same manner as in Example 1, except for the process described above.

Comparative Example 4

A benzophenone solution containing 10% by weight of benzophenone and 90% by weight of ethanol was used as a pretreatment solution. The chromium plate immersed in the pretreatment solution was ultrasonicated for 5 minutes and washed with hexane to prepare a pretreated chromium plate. A specimen was produced in the same manner as in Example 1 except for the process described above.

Experimental Example 1: DCB Test and Measurement of Water Contact Angle

The specimens produced in Example 1 and Comparative Examples 1 to 4 were subjected to a DCB test and measurement of water contact angle in order to determine the adhesive strength and the water contact angle thereof.

The DCB test was carried out as follows. The surfaces of the same two specimens were completely dried in a N2 gas stream. Next, the N2 gas was completely removed and then a Teflon film was laminated between PDMS-coated chromium plates. Then, heat treatment was performed in an oven at a temperature of about 70° C. for 24 hours to cross-link the two specimens. A universal tester (Instrument, Norwood, Mass., USA) was used as a fixture. The tester and the dried specimens were bonded together using an adhesive agent (401 Flex gel, Loctite, Dusseldorf, Germany). The maximum load was then measured when two specimens were separated at a crosshead speed of 5 mm/min. The water contact angle was measured using a contact angle analyzer (Phoenix-450, Surface Electro Optics, Suwon, Korea) and repeated 10 times for each specimen. The results are shown in Table 1 and FIG. 1.

TABLE 1

| Item | Pretreatment compound | Maximum load (N) | Water contact angle (° C.) |
|---|---|---|---|
| Example 1 | Myricetin | 26.1 ± 8.8 | 57 ± 2 |
| Comparative Example 1 | — | 16.2 ± 3.7 | 67 ± 5 |
| Comparative Example 2 | Quercetin | 21.9 ± 2.5 | 55 ± 6 |
| Comparative Example 3 | Trimesoyl chloride | 20.2 ± 4.1 | 59 ± 10 |
| Comparative Example 4 | Benzophenone | 19.1 ± 2.1 | 63 ± 4 |

It can be seen from the results shown in Table 1 that, when the myricetin compound was used as the pretreatment solution in Example 1, the maximum load was the highest because the pyrogallol group was bound to the surface of the chromium plate. As a result, the adhesive strength between the metal and the resin was remarkably improved.

On the other hand, in Comparative Example 1, the maximum load was lowest because the surface of the chromium plate was not pretreated. As a result, it can be seen that the adhesive strength between the metal and the resin was relatively poor compared to Example 1.

In addition, in Comparative Example 2, the maximum load was improved compared to Comparative Example 1, since the catechol group was bound to the surface of the chromium plate and thus the adhesive strength between the chromium plate and the polymer resin was excellent without any oxidizing group on the metal surface.

In Comparative Example 3, the highly reactive acrylic chloride bound to the surface of the chromium plate reacted with OH groups on the metal surface to improve the adhesive strength between the metal and the resin.

In Comparative Example 4, a benzophenone compound forming a radical caused a binding reaction between a polar group on the surface of the chromium plate and a polymer, thereby exhibiting an improved maximum load compared to Comparative Example 1. However, the maximum load was relatively low compared to Example 1.

On the other hand, the water contact angle shown in Table 1 is an indicator of the degree of polarity of the surface. It can be seen that the water contact angles in Example 1 and Comparative Examples 2 to 4 including pretreatment of the chromium plate was decreased compared to that of Comparative Example 1, which means that the pretreatment compounds were adsorbed on the chromium surface.

FIG. 1 shows a graph showing the results of DCB (double cantilever beam) evaluation regarding the specimens produced in Example 1 and Comparative Examples 1 to 4. RAs shown in FIG. 1, a is Comparative Example 1, b is Example 1, c is Comparative Example 2, d is Comparative Example 3, and e is Comparative Example 4, respectively. The results of FIG. 1 show that Example 1 exhibited increased displacement with the highest maximum load compared to Comparative Examples 1 to 4. The increased maximum load means adhesive strength. In FIG. 1, x represents the cutting point of the specimen.

Experimental Example 1: Measurement of XPS and Water Contact Angle

XPS (X-ray photoelectron spectroscopy) analysis was performed on the specimens produced in Example 1 and Comparative Examples 1 to 4 in order to determine the composition of the surface of the specimens after the DCB test. The XPS analysis was repeated 10 times for each specimen using an X-ray photoelectron spectroscope (K-alpha+, Thermo Fisher Scientific, Waltham, Mass., USA). The results are shown in Table 2 and FIGS. 2 to 5 below.

TABLE 2

| Immersion time | | 10 sec | 20 sec | 51 sec |
|---|---|---|---|---|
| Example 1 | Si 2p | 7.9 | 4.4 | 2.4 |
| | C 1s | 54.5 | 55.1 | 58.0 |
| | Cr 2p | 1.5 | 6.2 | 7.1 |
| Comparative Example 1 | Si 2p | 5.5 | 2.3 | 1.0 |
| | C 1s | 38.5 | 12.4 | 10.4 |
| | Cr 2p | 6.6 | 18.2 | 19.8 |
| Comparative Example 2 | Si 2p | 17.2 | 12.1 | 4.1 |
| | C 1s | 50.4 | 36.7 | 28.6 |
| | Cr 2p | 1.1 | 7.6 | 14.2 |
| Comparative Example 3 | Si 2p | 9.3 | 4.4 | 1.7 |
| | C 1s | 44.7 | 13.8 | 10.3 |
| | Cr 2p | 3.8 | 17.9 | 22.0 |
| Comparative Example 4 | Si 2p | 6.9 | 3.4 | 1.0 |
| | C 1s | 31.5 | 10.4 | 9.9 |
| | Cr 2p | 7.9 | 18.1 | 20.1 |

(Unit: atomic percent (at %))

As can be seen from the results of Table 2, in Example 1, a relatively high carbon content and a low chromium content were detected on the surface of the crushed chromium plate after measurement of DCB. It can be seen that the surface of the chromium plate and the pyrogallol group were strongly bound to each other and that the binding was removed due to desorption from the polymer resin after DCB measurement. Also, it can be seen that, as the immersion time increased, the binding amount between chromium and carbon increased.

On the other hand, in Comparative Example 1, it can be seen that pretreatment was not performed, but carbon was present on the surface of the chromium plate due to the adsorption of carbon dioxide and a small amount of contaminants thereon. However, it can be seen that the content of carbon left after the measurement of DCB decreased rapidly because of the weak binding force between carbon and chromium. Also, it can be seen that the relative chromium content was increased due to desorption of the adsorbed materials.

Also, in Comparative Examples 2 to 4, it can be seen that the contents of carbon and chromium left after measurement of DCB were relatively greater than those of Comparative Example 1 because of the excellent binding force between each functional group and chromium through pretreatment.

Figure 2:
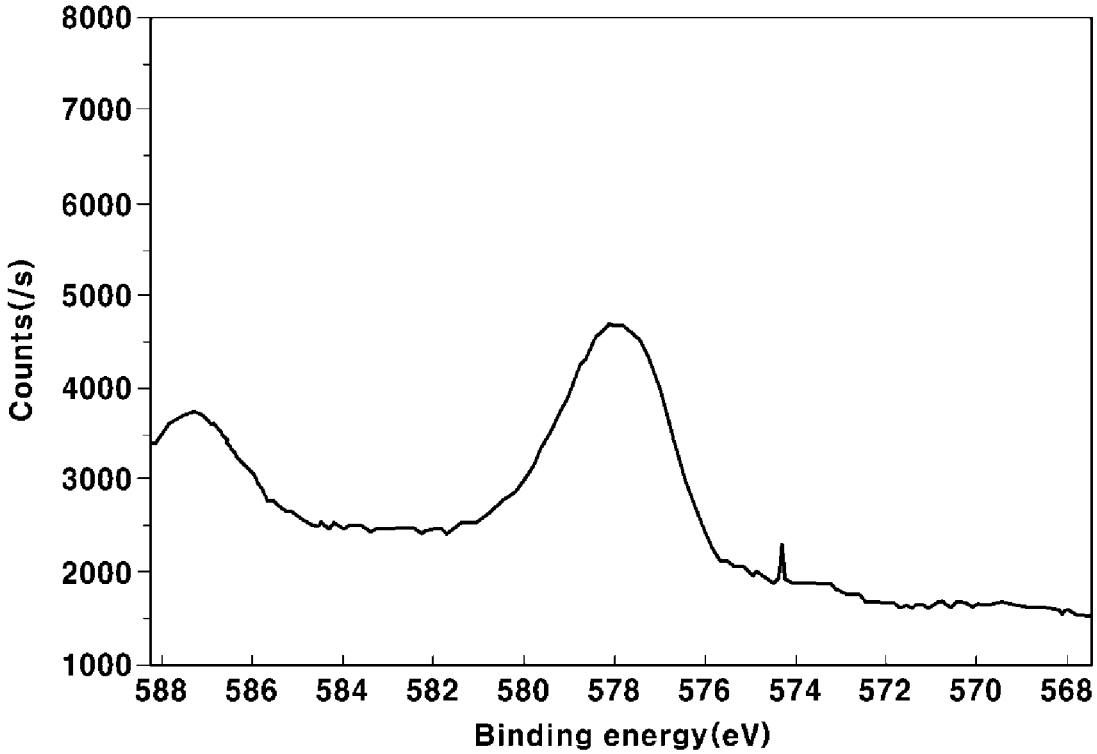
FIG. 2 shows a graph showing the results of XPS analysis regarding the surface composition of the specimen produced in Comparative Example 1.
Figure 3:
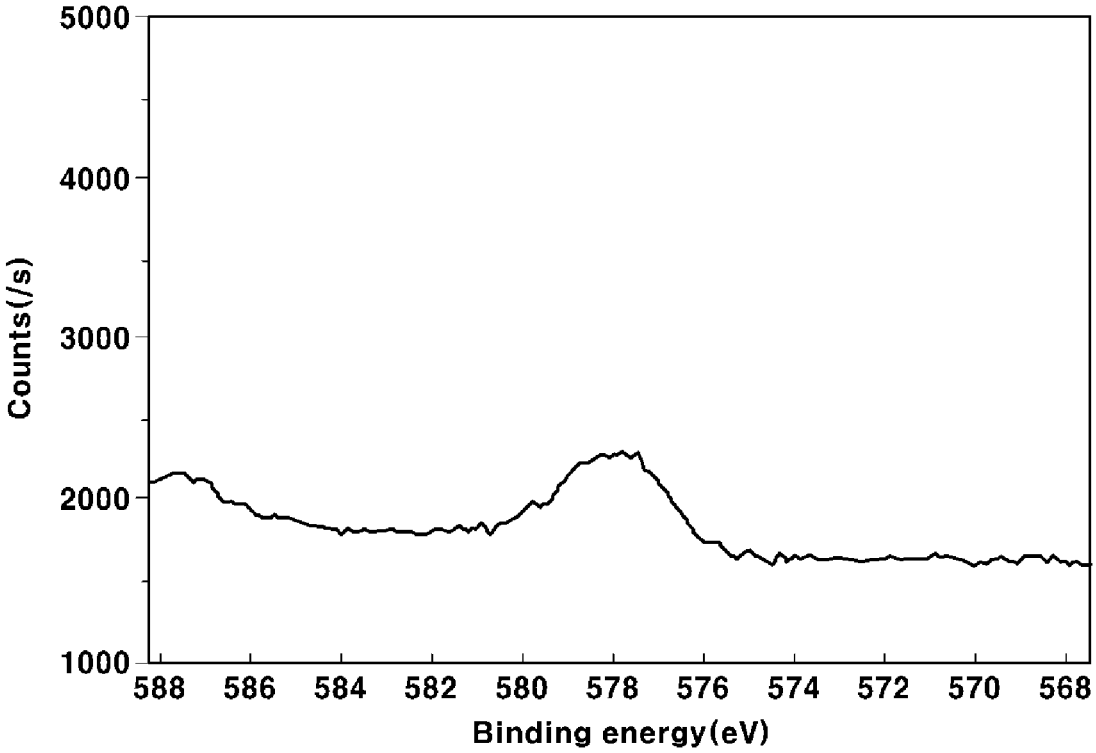
FIG. 3 shows a graph showing the results of XPS analysis regarding the surface composition of the specimen produced in Example 1 according to an exemplary embodiment of the present invention.

FIG. 2 shows a graph showing the results of XPS analysis regarding the surface composition of the specimen produced in Comparative Example 1. FIG. 3 shows a graph showing the results of XPS analysis regarding the surface composition of the specimen produced in Example 1.

Figure 4:
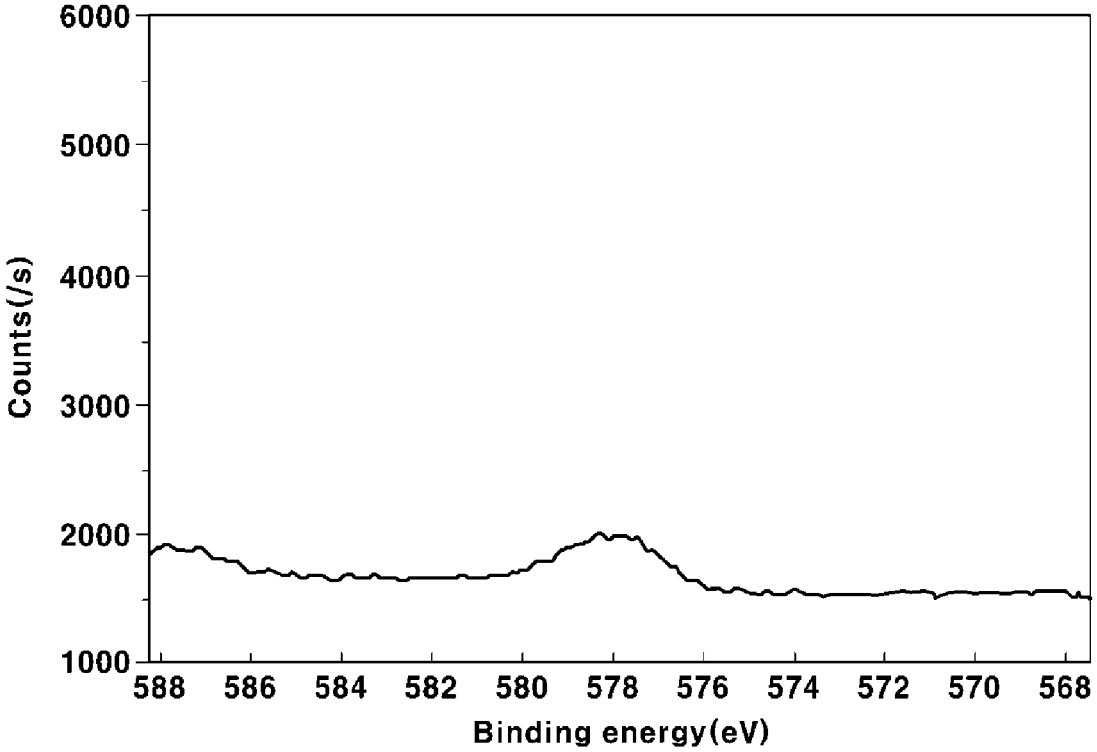
FIG. 4 shows a graph showing the results of XPS analysis regarding the surface composition of the specimen produced in Comparative Example 2.
Figure 5:
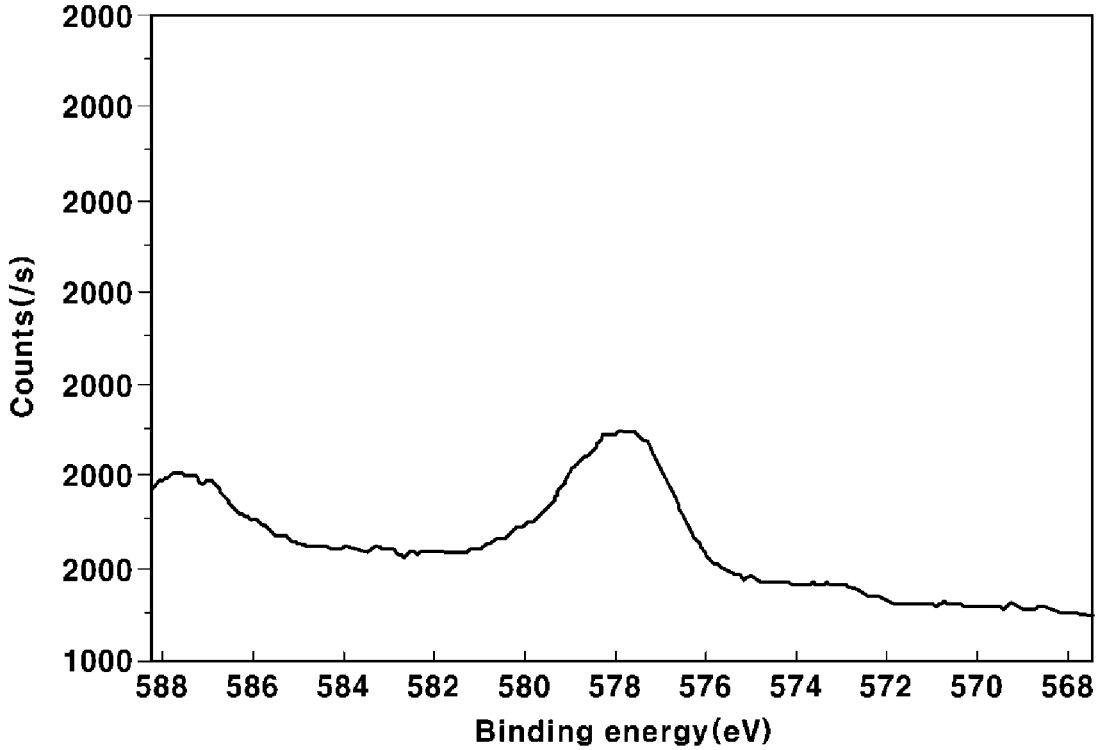
FIG. 5 shows a graph showing the results of XPS analysis regarding the surface composition of the specimen produced in Comparative Example 3.

FIG. 4 shows a graph showing the results of XPS analysis regarding the surface composition of the specimen produced in Comparative Example 2. FIG. 5 shows a graph showing the results of XPS analysis regarding the surface composition of the specimen produced in Comparative Example 3.

As can be seen from FIGS. 2 to 5, the black arrow indicates the reduction of oxidized chromium and the red dotted arrow indicates the increase of chromium metal over an immersion time (10 to 402 seconds). In particular, as can be seen in FIG. 3, the peak of chromium oxidized was most remarkably small, while the peak of the chromium metal was relatively large. This indicates the property whereby the pyrogallol group directly binds to the metal without using any oxidizing group on the surface of the chromium plate.

In FIG. 4, the peak of oxidized chromium was smaller than those of FIGS. 2 and 5, which was found to be due to the property whereby the catechol group was directly bound to a metal. Also, as can be seen from FIGS. 2 and 5, the peak of the oxidized chromium was greater than that of the chromium metal, which means that the oxidizing group of the metal may be required.

As apparent from the foregoing, as described above, the method for improving the adhesive strength between heterogeneous materials of a metal and a resin according to the exemplary embodiments of the present invention may preferably include pretreating the surface of a metal plate with an aromatic compound containing a pyrogallol group to bind the pyrogallol group to the surface of the metal plate and coating the pyrogallol-group-bound metal plate with a polymer resin, thereby improving the adhesive strength between the metal and the polymer resin.

In addition, the method of improving the adhesive strength between heterogeneous materials of a metal and a resin according to the present invention may be advantageous in that the overall process can be easily performed by coating the surface of the metal plate with a pyrogallol group at room temperature in a simple spray-coating or dipping manner.

The effects of the present invention are not limited to those mentioned above. It should be understood that the effects of the present invention include all effects that can be inferred from the description of the present invention.

The invention has been described in detail with reference to various exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A method of attaching heterogeneous materials comprising a metal plate and a polymer resin, comprising:

removing contaminants on a surface of the metal plate;

after the removing the contaminants, treating the metal plate with a pretreatment solution comprising an aromatic compound having a pyrogallol group and a solvent component;

coating the surface of the pretreated metal plate with the polymer resin; and drying the polymer resin coated on the metal plate, wherein the polymer resin comprises polydimethylsiloxane (PDMS) polymer which is a compound represented by the following Formula 1,

[Formula 1]

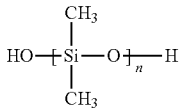

wherein n is an integer of 10 to 100.

2. The method according to claim 1, wherein the metal plate comprises metal components selected from the group consisting of trivalent chromium, hexavalent chromium, aluminum, and an alloy thereof.

3. The method according to claim 1, wherein the pretreatment solution comprises an amount of about 0.1 to 15% by weight of the aromatic compound comprising the pyrogallol group and an amount of about 85 to 99.9% by weight of the solvent, based on the total weight of the pretreatment solution.

4. The method according to claim 1, wherein the aromatic compound comprises myricetin, gallacetophenone or a combination thereof.

5. The method according to claim 1, wherein the solvent component comprises one or more selected from the group consisting of methanol, ethanol, and propanol.

6. The method according to claim 1, wherein the pretreatment is carried out by spray coating or immersion.

7. The method according to claim 1, wherein the immersion is carried out by immersing the metal plate in the pretreatment solution and ultrasonicating the metal plate at a temperature of about 10 to 30° C. for about 1 to 10 minutes.

8. The method according to claim 1, wherein the pretreated metal plate comprises carbon atoms bound to the surface of the metal plate in an amount of about 30 to 50 atomic percent (at %) with respect to the entire surface area of the metal plate.

9. The method according to claim 1, wherein the polymer resin further comprises one or more selected from the group consisting of polyurethane, and polyacryl.

10. The method according to claim 1, wherein the drying is carried out by heat-treating at a temperature of about 65 to 100° C. for about 20 to 30 hours.

* * * * *